United States Patent [19]

Owens

[11] Patent Number: 5,062,738

[45] Date of Patent: Nov. 5, 1991

[54] ROLLER SCREED

[76] Inventor: Joe M. Owens, 842 Lake Holiday Dr., Sandwich, Ill. 60548

[21] Appl. No.: 510,008

[22] Filed: Apr. 17, 1990

[51] Int. Cl.[5] ..... E01C 19/00

[52] U.S. Cl. ..... 404/114; 404/118; 404/103

[58] Field of Search ..... 404/114, 118, 117, 120, 404/122, 103, 128

[56] References Cited

U.S. PATENT DOCUMENTS

| | | | |
|---|---|---|---|
| 3,547,014 | 12/1970 | Austin | 404/117 |
| 3,841,777 | 10/1974 | Domenighetti | 404/114 X |
| 4,702,640 | 10/1987 | Allen | 404/103 |
| 4,752,156 | 6/1988 | Owens | 404/118 |
| 4,838,730 | 6/1989 | Owens | 404/114 |
| 4,861,188 | 8/1989 | Rouillard | 404/114 X |

*Primary Examiner*—Ramon S. Britts
*Assistant Examiner*—Nancy P. Connelly
*Attorney, Agent, or Firm*—Lee, Mann, Smith, McWilliams & Sweeney

[57] ABSTRACT

A portable screed for smoothing and leveling an area of freshly poured concrete. The screed includes a cylindrical, horizontal smoothing roller secured to the screed plate for the screed, the roller being substantially coextensive with the screed plate. The roller is mounted immediately adjacent the screed so that the roller first encounters and smooths concrete before the screed plate passes over the concrete. The roller is adjustable to control its working of the concrete, and rotates about its axis in a direction opposite to the direction of travel of the screed for proper smoothing of the concrete.

11 Claims, 3 Drawing Sheets

DIRECTION OF TRAVEL

ROLLER SCREED

BACKGROUND OF THE INVENTION

This invention relates to screeding of freshly-poured concrete, and in particular to a screed employing an initial roller for accurately treating the concrete surface as the screed proceeds along the concrete.

As set forth in my U.S. Pat. No. 4,838,730, the disclosure of which is incorporated herein by reference, precise tolerances are being demanded for concrete surfaces, therefore leading to development of concrete working apparatus which can produce finished concrete to meet those tolerances. In my U.S. Pat. No. 4,752,156, I describe a laser-guided screed as one type of apparatus which can meet such tolerances.

Concrete forms are also used to guide a screed to close tolerances. Typically, forms are placed on either side of an area which is to be covered with concrete, concrete is poured in that area, and a screed is drawn across that area to not only precisely level the concrete, but also, if vibratory, properly settle the aggregate in the concrete to assure that surface spalling does not occur.

SUMMARY OF THE INVENTION

The invention provides a portable screed for smoothing and leveling an area of freshly poured concrete, the screed having an elongated screed plate with a flat bottom bearing surface and further having means extending along the length of the screed plate for accumulating and transporting quantities of plastic concrete. The screed has a cylindrical, horizontal smoothing roller secured to the screed plate, the roller having a length substantially coextensive with the length of the screed plate. The roller is mounted immediately adjacent the means for accumulating and transporting the plastic concrete such that when the screed is used to smooth and level concrete, the roller encounters portions of plastic concrete before the balance of the screed encounters such portions.

Means is also provided for adjusting the elevation of the roller relative to the bottom bearing surface of the screed. The roller is rotated about its axis in a direction opposite to the direction of travel of the screed. That is to say, the rotation of the roller opposes the forward movement of the screed in order to accumulate excess concrete in front of the roller as the screed advances.

The roller is preferably continuous along its length. In accordance with the preferred form of the invention, the mounting means comprises a support bracket at each end of the roller, each bracket being secured to the screed plate. For adjusting the height of the roller, a bearing is provided at each end of, and for rotation of, the roller. An upwardly extending shaft is secured to each bearing and is engaged in the respective end bracket. The shaft is threaded for vertical shifting of the shaft relative to the bracket for raising and lowering of the roller. A pair of adjustment nuts are mounted on the shaft, one of the nuts being located above the bracket and the other of the nuts being located beneath the bracket so that the bracket can be sandwiched between the nuts for securely locating the roller at a particular elevation.

The roller is preferably used in combination with an elongated, concave scoop extending substantially the length of the screed plate and forming the forward edge of the screed plate. When sufficient quantities of concrete have accumulated in front of the scoop, the closely adjacent roller engages the built-up concrete, and pushes the concrete forwardly of the screed. Thus, the roller and the scoop work in tandem for precise handling and leveling of plastic concrete.

Each of the support brackets for the roller is attached to the scoop, and each includes an arm extending outwardly from the screed plate for proper positioning of the roller in front of the screed plate. One of the brackets also serves a dual function as a bearing block and support for the drive for rotation of the roller.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
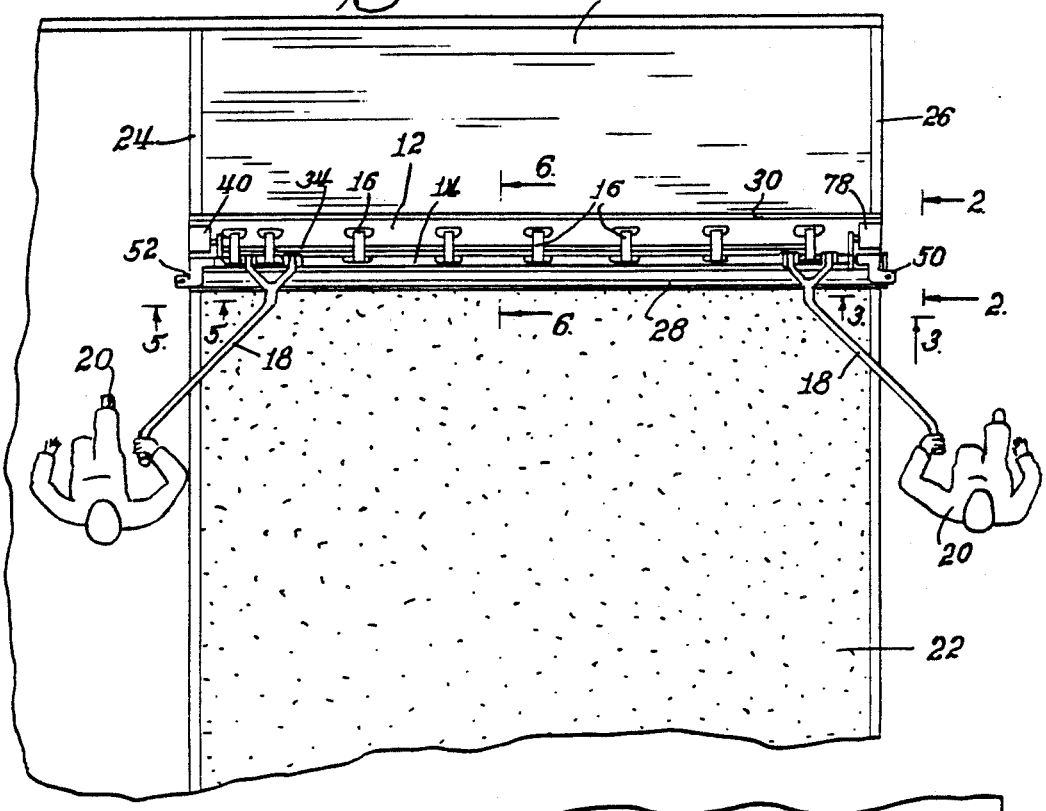
FIG. 1 is a top plan view of the invention when employed in the process of smoothing freshly-poured concrete.

A screed according to the invention is shown generally at 10 in the drawing figures. The screed 10 includes an elongated screed plate 12, a stiffening brace 14 extending substantially the length of the screed plate 12, a series of rigid, spaced cross supports 16 secured to both the brace 14 and the screed plate 12, and a pair of control bars 18 mounted so that operators 20 may guide the screed over a concrete surface 22 contained between a pair of forms 24 and 26. The screed 10 also includes a smoothing roller 28 mounted on the forward side of the screed.

The screed plate 12 is generally flat, having substantially straight ends and an up-turned rear lip 30 extending the length thereof so that, if the operators 20 push the screed rather than pulling it toward themselves, the screed plate 12 will not tend to dive into the plastic concrete 22. The brace 14 extends substantially the length of the screed plate 12, and is identical to the brace shown and described in referenced U.S. Pat. No. 4,838,730, from which a more detailed description may be obtained. The brace 14 includes a longitudinal concave scoop 32 extending the length of its facing side for collecting excess concrete as the screed 10 is drawn along the concrete 22.

The cross supports 16 are spaced at regular intervals along the length of the screed plate 12, and provide stiffening support for the screed plate 12. As described in greater detail in referenced U.S. Pat. No. 4,838,730, the cross supports carry the necessary vibratory mechanism including a rotatable shaft 34 and eccentric weights 36, and a sleeve or guide 38 for fine adjustment of the bottom surface of the screed plate 12. All of these elements and features are described in detail in referenced U.S. Pat. No. 4,838,730, from which greater detail may be obtained.

Figure 6:
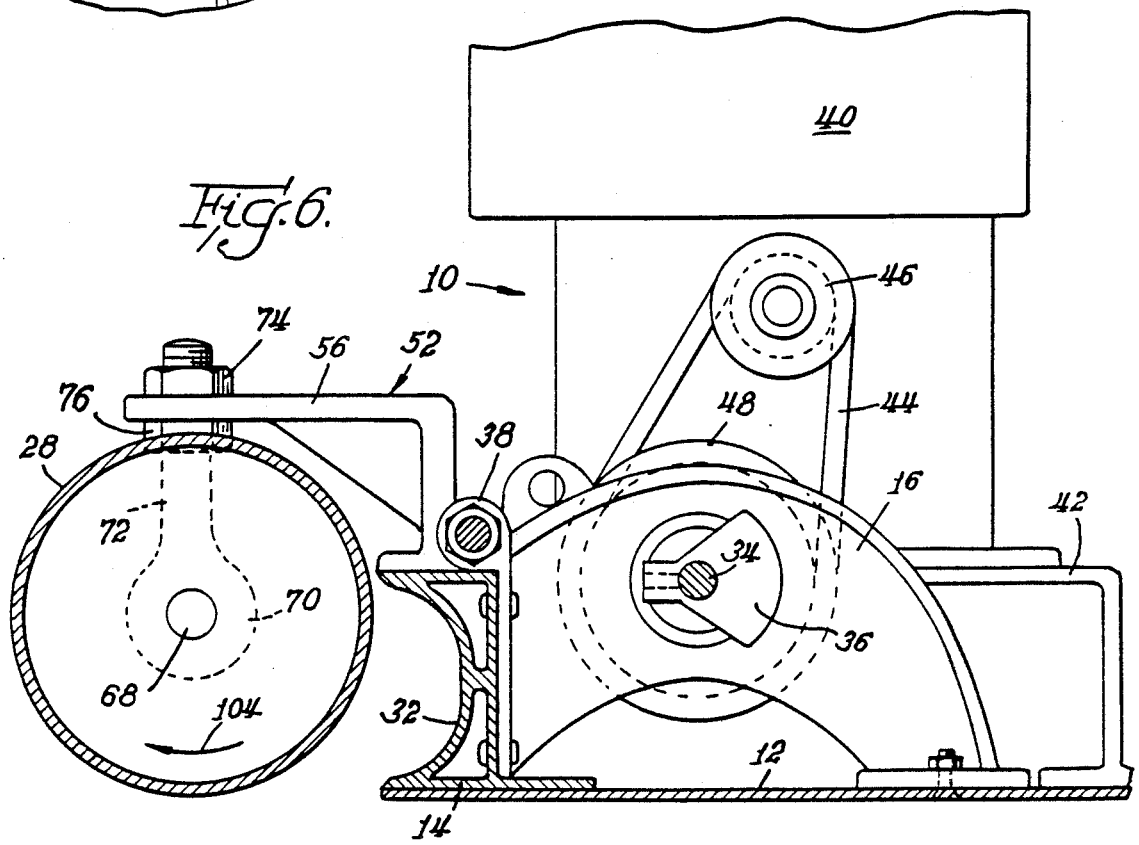
FIG. 6 is a partial cross-sectional view of the screed, enlarged and taken along lines 6—6 of FIG. 1.

For driving of the shaft 34, a motor 40 is mounted at one end of the screed plate 12. As best shown in FIG. 6, the motor 40 is situated on a frame 42 secured to the screed plate 12, and drives the shaft 34 by means of a belt 44 passing between a motor pulley 46 and a pulley 48 appropriately secured to the shaft 34.

The roller 28 is preferably hollow, and is secured to the screed 10 by means of respective end brackets 50 and 52, both of which are appropriately secured to the top of the brace 14. The brackets 50 and 52 include respective outwardly extending arms 54 and 56 for mounting of the roller 28.

The end of the roller 28 beneath the bracket 50 has an outwardly extending axle 58 engaged within a bearing 60. An upwardly extending threaded shaft 62 passes through an aperture in the arm 54, and is captured on the end bracket 50 by means of a pair of nuts 64 and 66, the nut 64 being located above the bracket 50 and the nut 66 being located beneath the bracket 50 so that the bracket arm 54 is sandwiched between the nuts. The nuts 64 and 66 are adjustable along the threaded shaft 62 to appropriately raise and lower the axle 58 and therefore raise and lower one end of the roller 28.

At the opposite end of the roller 28, an axle 68 extends into a bearing 70. A shaft 72 extends upwardly from the bearing 70, extending through an aperture in the arm 56 of the bracket 52. The shaft 72, which is threaded, is captured within the bracket 52 by means of nuts 74 and 76, the nut 74 being located above the bracket 52, and the nut 76 being located beneath the bracket. In exactly the same manner as with respect to the other end of the roller 28, judicious adjustment of the nuts 74 and 76 along the threaded shaft 72 appropriately positions the elevation of the roller 28 with respect to the screed plate 12.

The roller 28 is driven by a motor 78 mounted on a frame 80 appropriately secured to the screed plate 12. Both of the motors 40 and 78 may be internal combustion type motors, the motor 78 being shown with common components such as a fuel tank 82, pull start 84 and spark plug 86. The motors 78 and 40 may be conventional and are therefore not described in further detail.

The motor 78 is drivingly linked to the roller 28 by means of a first chain 88 passing over a motor sprocket 90 and a transfer sprocket 92. The sprocket 92 is mounted on an axle 94 passing through a bearing block 96 formed in the bracket 50. The axle 94 emerges from the bearing block 96 and is capped by a second transfer sprocket 98. That sprocket, in turn, drives a second chain 100 which passes over a drive sprocket 102 secured to the axle 58. The motor 78 rotates the roller 28 in the direction shown at 104 in FIG. 2, that direction of rotation being opposed to the direction of travel 106 of the screed 10, also shown in FIG. 2.

Figures 2, 3:
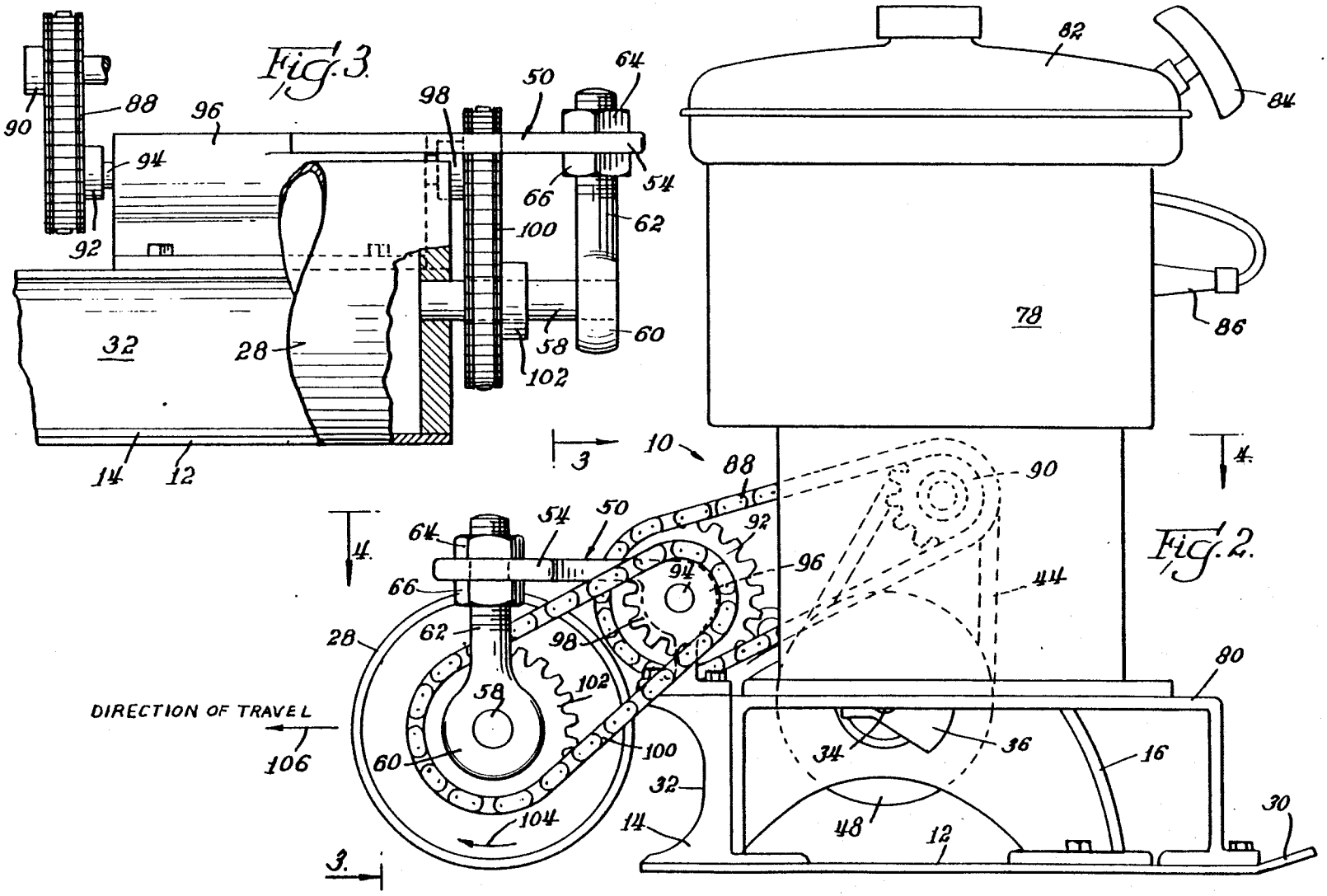
FIG. 2 is an enlarged, end view taken along the direction 2—2 of FIG. 1.
FIG. 3 is a view taken along lines 3—3 of FIG. 2, to the extent along the screed depicted by the lines 3—3 of FIG. 1.
Figure 4:
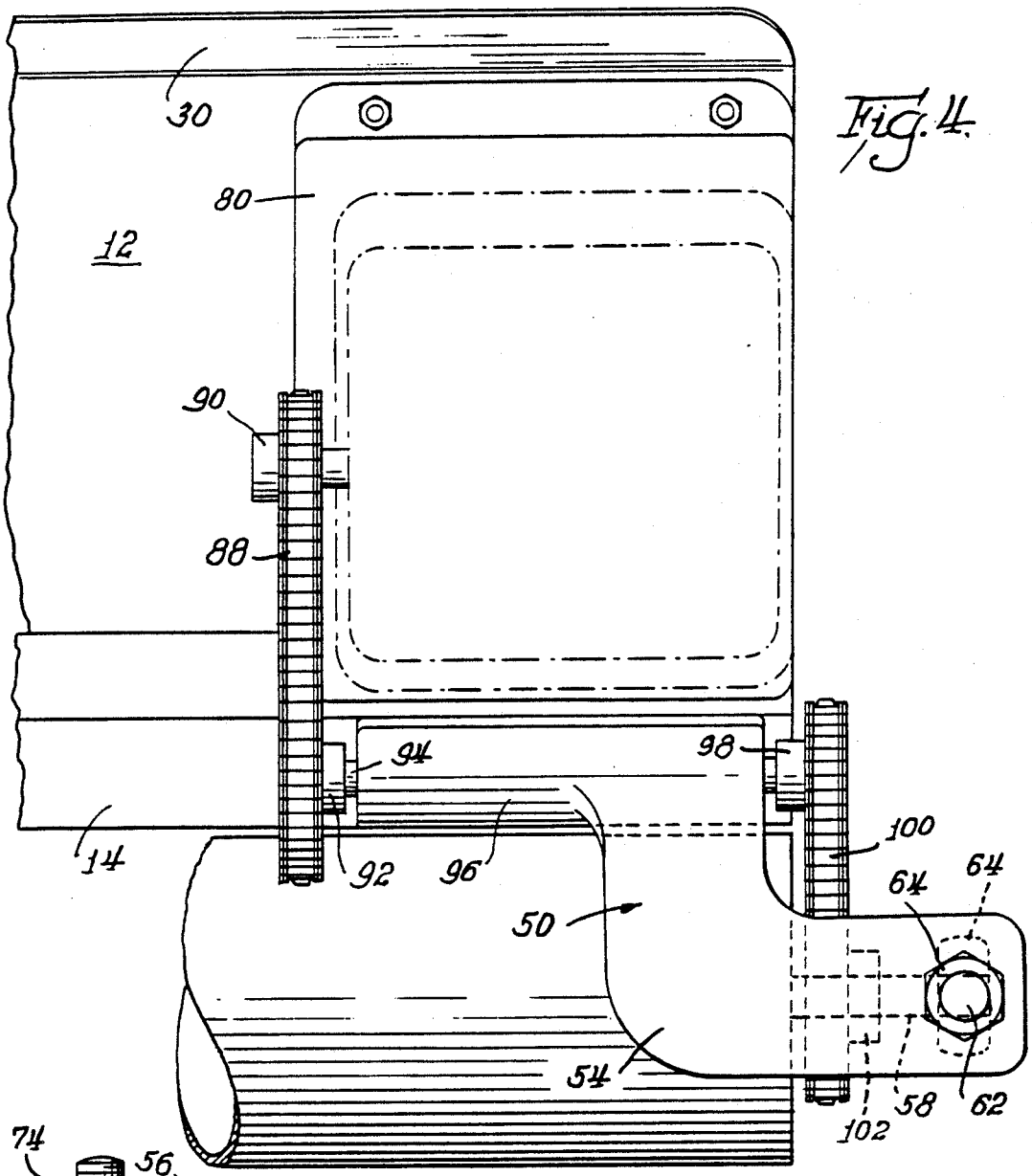
FIG. 4 is a partial cross-sectional view of one end of the screed taken along lines 4—4 of FIG. 2.
Figure 5:
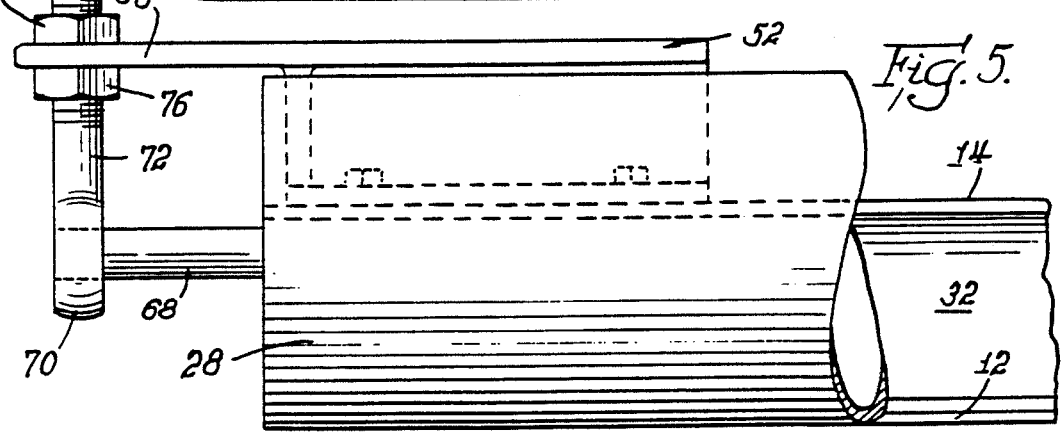
FIG. 5 is an enlarged partial elevational view of the opposite end of the screed, taken along lines 5—5 of FIG. 1.

As best shown in FIGS. 2 and 6, the roller 28 is mounted as closely as possible to the concave scoop 32 of the brace 14. When the screed 10 is used and pulled by the operators 20, the rotating roller 28 will accumulate excess concrete on its forward side (the left in FIGS. 2 and 6), due to the rotation of the roller 28 against the direction of travel 106. In addition, concrete also will accumulate in the concave scoop 32. When sufficient quantities of concrete collect in the scoop 32, the accumulated concrete engages the roller 28 and is moved forward of the screed 10 by the rotation of the roller 28. The quantity of concrete accumulating in front of the scoop 32 will depend upon the elevation of the roller 28 relative to the bottom of the screed plate 12, and the spacing between the roller 28 and the concave scoop 32. It is preferred that the roller 28 be mounted as close as possible to the brace 14 (i.e., the central axis of the roller 28 being spaced laterally from the brace 14 about the distance of the radius of the roller 28), so that any major accumulations of concrete will occur ahead of the roller 28 rather than in the scoop 32.

In operation, with the forms 24 in place and concrete 22 having been poured between the forms, the screed 10 is located by the operators 20 at one end of the poured concrete 22. With the motors 40 and 78 in operation, the operators 20 then move the screed 10 by means of the control bars 18, guiding the screed plate 12 along the forms 24 and 26. Excess concrete is moved ahead of the screed 10 by the roller 28, while vibration imparted by the eccentric weights 36 settles the concrete.

The screed 10 is as light as possible for easy portability. The screed plate 12 may be formed of aluminum, as may be the brace 14, and the cross supports 16 and end brackets 50 and 52 may be formed of integral castings, preferably of a magnesium aluminum alloy.

Various changes may be made to the invention without departing from the spirit thereof or scope of the following claims.

What is claimed is:

1. A portable screed for smoothing and leveling an area of freshly poured concrete, the screed having an elongated screed plate with a flat bottom bearing surface and having means extending at one side of the screed plate along the length of the screed plate for accumulating and transporting quantities of plastic concrete, the improvement comprising a. a cylindrical horizontal smoothing roller secured to the screed plate, said roller having a length substantially coextensive with the length of the screed plate, b. means rigidly mounting said roller in relation to said screed plate immediately adjacent and in front of said means for accumulating and transporting, such that when the screed is used to smooth and level concrete, said roller encounters portions of plastic concrete before said means for accumulating and transporting encounters such portions, c. means for adjusting the elevation of said roller relative to the bottom bearing surface of said screed plate, and d. means for rotating said roller about its axis in a direction opposite to the direction of travel of the screed.

2. A portable screed according to claim 1 in which said roller is a continuous roller along its length.

3. A portable screed according to claim 1 in which said mounting means comprises a support bracket at each end of said roller, each said bracket being secured to said screed plate.

4. A portable screed according to claim 3 in which said means for adjusting comprises a bearing at each end of and for rotation of said roller, and an upwardly-extending shaft secured to said bearing and engaged in said bracket, said shaft including means to vertically shift said shaft relative to said bracket.

5. A portable screed according to claim 4 in which said means to shift comprises threading of said shaft and a pair of adjustment nuts mounted thereon, one of said nuts being located above said bracket and the other of said nuts being located beneath said bracket such that said bracket can be sandwiched between said nuts.

6. A portable screed according to claim 1 in which said means for adjusting comprises a bearing at each end of and for rotation of said roller, and an upwardly-extending shaft secured to said bearing and engaging said mounting means, said shaft including means to vertically shift said shaft relative to said bracket.

7. A portable screed according to claim 6 in which said means to shift comprises threading of said shaft and a pair of adjustment nuts mounted thereon, one of said nuts being located above said mounting means and the other of said nuts being located beneath said mounting means such that said mounting means can be sandwiched between said nuts.

8. A portable screed according to claim 1 in which said means for rotating comprises an engine mounted on said screed plate.

9. A portable screed according to claim 1 in which said means for accumulating and transporting comprises an elongated, concave scoop extending substantially the length of said screed plate.

10. A portable screed according to claim 9 in which said mounting means includes a support bracket at each end of said roller, each bracket being secured to said scoop and including an arm extending outwardly from said screed plate.

11. A portable screed according to claim 10 in which said means for adjusting comprises a bearing at each end of said roller and an upwardly-extending shaft secured to said bearing and shiftably engaged in said arm.

* * * * *